US010470536B1

(12) United States Patent
Lundaas

(10) Patent No.: US 10,470,536 B1
(45) Date of Patent: Nov. 12, 2019

(54) CUP AND BOTTLE HOLDER ASSEMBLY FOR A WALKING AID

(71) Applicant: Terje Lundaas, Coral Gables, FL (US)

(72) Inventor: Terje Lundaas, Coral Gables, FL (US)

( * ) Notice: Subject to any disclaimer, the term of this patent is extended or adjusted under 35 U.S.C. 154(b) by 0 days.

(21) Appl. No.: 16/142,175

(22) Filed: Sep. 26, 2018

(51) Int. Cl.
*A45B 3/00* (2006.01)
*A45B 9/00* (2006.01)
*A45B 1/00* (2006.01)

(52) U.S. Cl.
CPC *A45B 3/00* (2013.01); *A45B 1/00* (2013.01); *A45B 9/00* (2013.01); *A45B 2009/002* (2013.01); *A45B 2009/005* (2013.01)

(58) Field of Classification Search
CPC .... A45B 3/00; A45B 3/10; A45B 3/14; A45B 3/16; A45B 1/00; A45B 1/04; A45B 5/00; A45B 7/00; A45B 9/00; A45B 2009/002; A45B 2009/005; A61H 3/06; A61H 3/02; A61H 3/0222; A61H 3/0255; A61H 3/00; A61H 3/068
USPC ..... 248/311.2, 230.1; 224/407, 148.7; 135/66, 68
See application file for complete search history.

(56) References Cited

U.S. PATENT DOCUMENTS 2,516,852 A 8/1950 Burry et al.
2,540,818 A * 2/1951 Gilhooly ..... F17C 13/084 248/312
2,926,879 A * 3/1960 Dietrich ..... A47G 23/0225 224/406
3,003,646 A * 10/1961 Wolf ..... A47F 5/04 211/107
3,069,189 A * 12/1962 Hollaender ..... E04G 7/14 285/188
3,131,842 A * 5/1964 Dingle, Jr. ..... A63B 55/60 224/274
3,212,743 A * 10/1965 Culver ..... A47F 7/28 248/229.17
3,773,288 A 11/1973 Bolton
3,790,116 A * 2/1974 Schulman ..... A47B 61/02 211/107
4,294,481 A * 10/1981 Pearl ..... F17C 13/084 248/129
4,300,742 A * 11/1981 Hunn ..... A47G 25/12 248/229.26

(Continued)

FOREIGN PATENT DOCUMENTS

DE 202005001865 U1 4/2005
DK 177804 B1 7/2014
GB 2326590 A 12/1998

*Primary Examiner* — Nkeisha Smith
(74) *Attorney, Agent, or Firm* — Glenn E. Gold, P.A.; Glenn E. Gold

(57) ABSTRACT

A combined cup and bottle holder assembly is configured for mounting to the shaft of a walking aid. A bottle support component has bottle-engaging structure that projects outwardly in a first direction, and has a first half of a coupling structure that projects outwardly in an opposite second direction. A cup retention subassembly has a gyroscopic cup-holding portion that projects outwardly in the second direction, and has a second half of the coupling structure that projects outwardly in the first direction. An attachment pin selectively couples the first and second coupling structure halves to one another about the shaft length. The gyroscopic cup-holding portion includes a two-axis gimbal arrangement.

16 Claims, 9 Drawing Sheets

(56) References Cited

U.S. PATENT DOCUMENTS 4,643,342 A * 2/1987 Borelli, III ..... B60N 3/18 224/275
4,721,276 A * 1/1988 Moss ..... B60N 3/10 248/205.2
4,819,843 A * 4/1989 Nakayama ..... B60N 3/103 108/44
4,826,058 A * 5/1989 Nakayama ..... B60N 3/102 224/275
4,844,399 A * 7/1989 Harm ..... A63B 55/60 248/311.2
4,895,330 A * 1/1990 Anstead ..... A45B 1/04 248/229.12
4,972,982 A * 11/1990 Harbour ..... A45F 5/00 224/148.4
4,998,700 A 3/1991 McKaig
5,046,699 A * 9/1991 Perreault ..... E04H 12/2223 135/16
5,056,545 A * 10/1991 Spaeth ..... A45B 1/00 135/66
5,152,489 A * 10/1992 Christensen ..... A63B 47/002 211/14
5,190,257 A * 3/1993 Gradei ..... B62J 11/00 248/231.71
5,249,770 A * 10/1993 Louthan ..... A47K 1/09 248/205.2
5,405,113 A * 4/1995 Jaw ..... B62J 11/00 224/425
5,456,437 A 10/1995 Chander et al.
5,484,129 A * 1/1996 Megal ..... A63B 55/408 224/274
5,494,248 A * 2/1996 Pratt ..... A63B 55/408 248/205.2
5,647,519 A * 7/1997 Brennan ..... A61H 3/02 135/66
5,664,718 A * 9/1997 Vine ..... B60N 3/103 224/413
5,803,327 A * 9/1998 Nipper ..... A61H 3/02 135/66
5,813,579 A * 9/1998 Hendrickson ..... B60N 3/103 224/42.11
5,901,891 A * 5/1999 Douglass ..... A61G 5/10 135/66
5,954,074 A 9/1999 Mattson
5,983,912 A 11/1999 Leu
6,032,808 A * 3/2000 Henson ..... A47G 7/044 211/85.23
6,352,135 B1 * 3/2002 Jones ..... E06C 7/143 182/120
6,443,172 B2 * 9/2002 Brumfield ..... A45B 1/00 135/16
6,502,283 B1 1/2003 Aguirre
6,505,802 B2 * 1/2003 Fowler ..... B60N 3/103 248/230.5
6,513,775 B1 2/2003 Hostetler
6,575,652 B2 * 6/2003 Krauss ..... F16D 1/087 403/49
6,802,484 B1 * 10/2004 Kiley ..... A47G 23/0225 248/121
6,837,470 B2 * 1/2005 Pacher ..... B60N 3/106 248/311.2
6,942,131 B2 * 9/2005 Trautman ..... B62J 11/00 224/414
7,087,002 B2 * 8/2006 Montgomery ..... A45B 7/005 135/65
7,207,450 B1 * 4/2007 Franklin ..... A45F 3/44 108/25
7,344,116 B2 * 3/2008 Ficarra ..... B63C 11/02 211/107
7,513,471 B2 * 4/2009 Moufflet ..... A47F 5/0892 248/218.4
7,549,430 B1 * 6/2009 Gravlee ..... A45B 3/00 108/50.12
7,588,225 B2 * 9/2009 Wawerski ..... B44D 3/14 16/425
7,699,508 B2 * 4/2010 Schroeder ..... G09F 23/04 116/173
7,726,327 B2 * 6/2010 Battiston ..... A61H 3/04 135/66
7,992,833 B1 8/2011 Goodman et al.
8,166,988 B1 * 5/2012 Martin ..... A61H 3/04 135/66
8,292,310 B2 * 10/2012 Turner ..... A61H 3/04 280/47.34
8,322,666 B2 * 12/2012 Duemmel ..... A45B 11/00 248/163.1
8,342,468 B1 * 1/2013 Strickland ..... A47G 23/0225 224/148.1
8,500,609 B1 * 8/2013 Williams ..... A63C 11/228 135/65
8,887,929 B2 * 11/2014 Erlenbach ..... B25H 5/00 211/193
8,894,030 B2 * 11/2014 Nixon ..... B62J 11/00 220/737
9,228,601 B2 * 1/2016 Fang ..... F16B 7/042
9,345,297 B2 * 5/2016 Brady ..... A45B 9/02
9,345,354 B2 * 5/2016 Nicolopulos ..... A47F 5/02
9,801,437 B2 * 10/2017 Ho ..... A45B 3/04
10,064,477 B2 * 9/2018 Nelson ..... A45F 3/22
10,086,734 B2 * 10/2018 Ferreira Orta ..... B60N 3/10
10,143,614 B1 * 12/2018 Pelletier ..... A61H 3/02
2002/0096610 A1 * 7/2002 Fernandez ..... G09F 7/18 248/218.4
2005/0035251 A1 * 2/2005 Wallin ..... A45B 1/00 248/230.1
2005/0151040 A1 * 7/2005 Hsu ..... B62J 11/00 248/214
2006/0278783 A1 * 12/2006 Rubin ..... G09F 7/18 248/230.1
2007/0256993 A1 11/2007 Boddice et al.
2009/0145470 A1 * 6/2009 Couper ..... A45B 1/04 135/66
2010/0122994 A1 * 5/2010 Chuang ..... B62J 9/003 224/420
2014/0251395 A1 * 9/2014 Bailar ..... A45F 5/02 135/65

* cited by examiner

CUP AND BOTTLE HOLDER ASSEMBLY FOR A WALKING AID

FIELD OF THE INVENTION

The present invention relates generally to a cup and bottle holder assembly for a walking aid, and more particularly, is concerned with a combined cup and bottle holder assembly, configured to be releasably coupled to the shaft of a walking aid and which provides a cup holder that maintains a level orientation for a seated beverage cup during maneuvering of the walking aid.

BACKGROUND OF THE INVENTION

Walking aids are important pieces of equipment used to assist individuals with mobility problems. These aids offer support and balance as an individual walks, in addition to helping individuals as they rise from, or lower to, a seated position. Walking aids come in a variety of arrangements depending on the personal ambulatory needs and the severity of the condition, such as an infirmity or a disability. For example, an infirmity affecting one of the limbs, such as a broken leg or ankle, may require the use of a single crutch. However, more serious impediments, such as degenerative conditions affecting both limbs, might require a pair of crutches. There are a variety of crutch types; however, the three main types of crutches generally include Axillary (or underarm) crutches, Forearm (or Lofstrand) crutches, and Platform crutches. Furthermore, there are non-crutch type walking aids such as walkers, which consist of a four-legged framework having handle bars that the individual grips and leans on. This type of walker is frequently in use to attend to the care of those in the geriatric population.

One of the challenges faced by those using a walking aid, of whatever variety, is the difficulty in carrying items with them. Walking aids are not hands-free equipment like wheelchairs. Rather, in use, walking aids require the operator to firmly grip corresponding handle bar portions. In the case of crutches, forward mobility is primarily undertaken by the user's manipulation of the crutches as controlled by the user's upper limbs. Even in the case of a four-legged walker, the user's hands and upper limbs are occupied in managing the movement of the walker. While upright, whether walking or merely standing, the user is constantly gripping the handle bars of the walking aid to sustain support and balance. The hands of the user are therefore unavailable to hold onto and carry any items. In particular, it is exceedingly difficult, if not impossible, for a user of a walking aid to carry a beverage bottle. In the case of a beverage contained within an open-topped cup (e.g. a cup of coffee, water, soda, etc.), it would be virtually impossible for the user to prevent the liquid beverage from spilling. This is made even more difficult in the case of crutches, since the crutch shaft is maintained at an angle with respect to the ground. Furthermore, the crutch angle continuously changes as the user walks.

One solution to this problem involves the user carrying a backpack or waist pack loaded with the desired items. For example, typical cargo might include food and beverage items that would be especially important for individuals who face serious mobility impediments and therefore need to be more diligent ensuring that they carry a liquid beverage to stay well hydrated. As a result, particularly from the perspective of maintaining hydration, individuals who use walking aids often have to devise ways to carry a beverage with them—the most obvious solution involving some type of pack carried on the shoulders or about the waist that contains beverage containers. However, from a physical standpoint, considering that the user is already encumbered in some fashion requiting the use of a walking aid, this solution is not very tenable. A pack represents additional weight that is cumbersome to carry, especially in light of the user's halting gait and hunched posture that user's may typically experience. Moreover, even if the user could readily carry some kind of pack, the user still faces the issue of accessing the pack without fully disengaging from the walking aid.

Accordingly, it would be highly desirable to provide a mechanism releasably-attachable to a shaft of a walking aid in order to enable the user of the walking aid, and particularly an individual using a crutch or a pair of crutches, to carry a liquid beverage in both the form of a container, such as a bottle, as well as an open-topped cup, without requiring the use of the hands. With regard to an open-topped cup, it would be highly-desirable provide such a mechanism that would maintain the cup in a vertical, or non-tilted, orientation regardless of the angle of the supporting crutch. Since individuals commonly carry both bottle-type beverage containers and open-topped beverage-filled cups, it would be most desirable to provide such a mechanism that is adapted to carry both a bottle-type beverage container and an open-topped beverage cup.

BRIEF SUMMARY OF THE INVENTION

The present disclosure is generally directed to a combined cup and bottle holder assembly that features a bottle holder component and a cup holder component that are joined together using an integral coupling structure having mateable first and second half sections that are selectively releasably coupled together about the shaft of a walking aid, thus mounting the assembly to the walking aid. In one form, the cup holder component has a cup holding portion employing a gimbal arrangement.

In one aspect of the present invention, a combined cup and bottle holder assembly coupleable to a shaft length of a walking aid comprises:

a bottle support component having a bottle receiving and holding portion;

a cup support subassembly having a gimbal cup receiving and holding portion; and a coupling device including a first portion and a second portion selectively releasably coupleable together about the shaft length of the walking aid, the first portion disposed at a mounting end of the bottle support component and the second portion disposed at a mounting end of the cup support subassembly.

In another aspect of the invention, a combined cup and bottle holder assembly coupleable to a shaft length of a walking aid comprises:

a bottle support component having a bottle-holding portion projecting outwardly in a first direction, and having a first half of a coupling structure projecting outwardly in an opposite second direction; and a cup retention subassembly having a mounting support and a cup-holding portion projecting outwardly in a third direction, and having a second half of the coupling structure projecting outwardly in a fourth direction opposite the third direction, the cup retention subassembly being configured to define a gyroscopic relationship between the mounting support and the cup-holding portion.

In yet another aspect of the present invention, a combined cup and bottle holder assembly coupleable to a shaft length of a walking aid comprises:

a bottle support component having bottle-engaging structure projecting outwardly in a first direction and having a first half of a coupling structure projecting outwardly in an opposite second direction;

a cup retention subassembly having a gyroscopic cup-holding portion projecting outwardly in the second direction and having a second half of said coupling structure projecting outwardly in the first direction; and an attachment pin for selective coupling of said first and second coupling structure halves to one another about said shaft length.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION OF PREFERRED IMPLEMENTATIONS OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
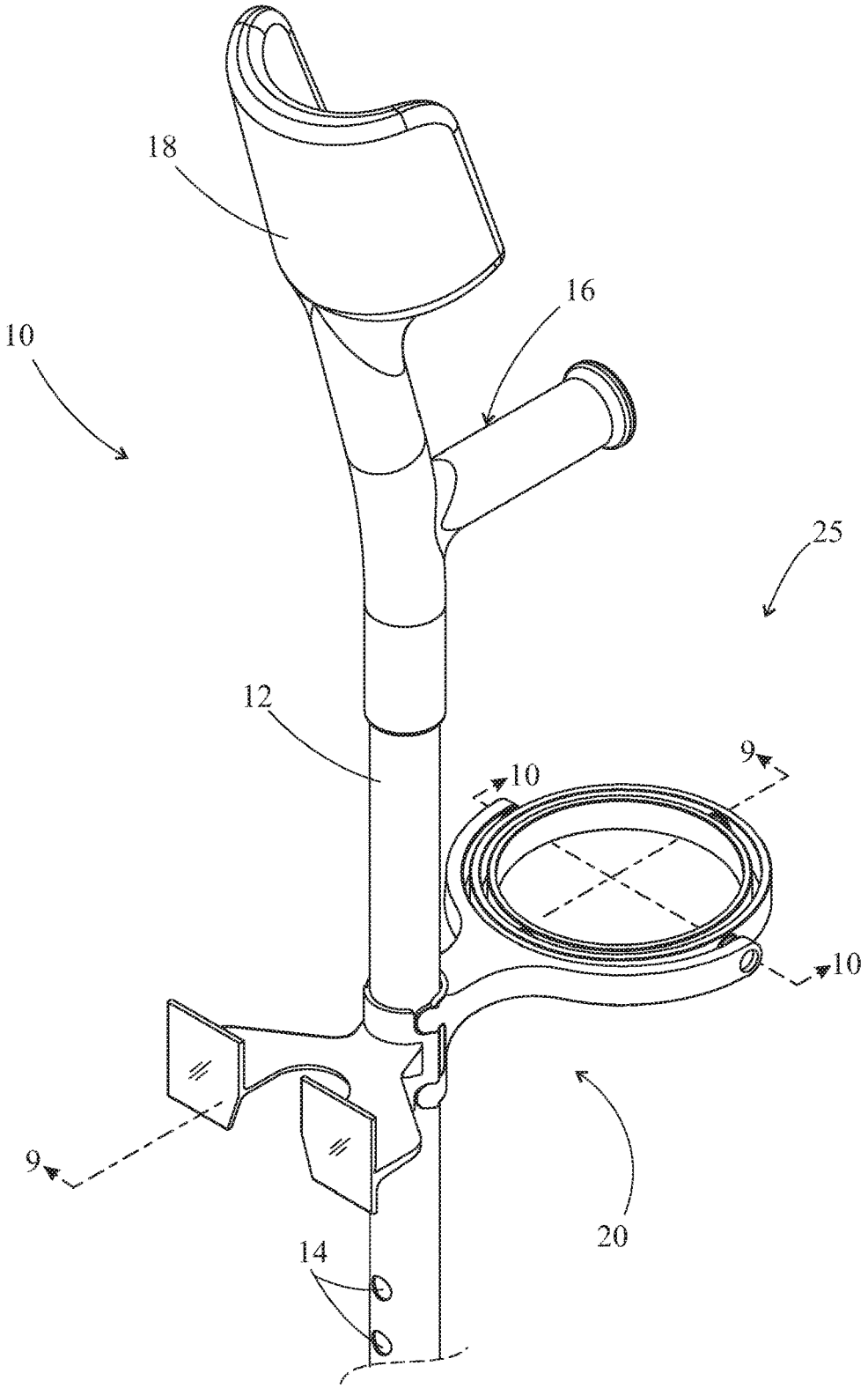
FIG. 1 presents a side elevation isometric view of a combined cup and bottle holder assembly as it is installed on a walking aid, in accordance with aspects of the present invention.
Figure 2:
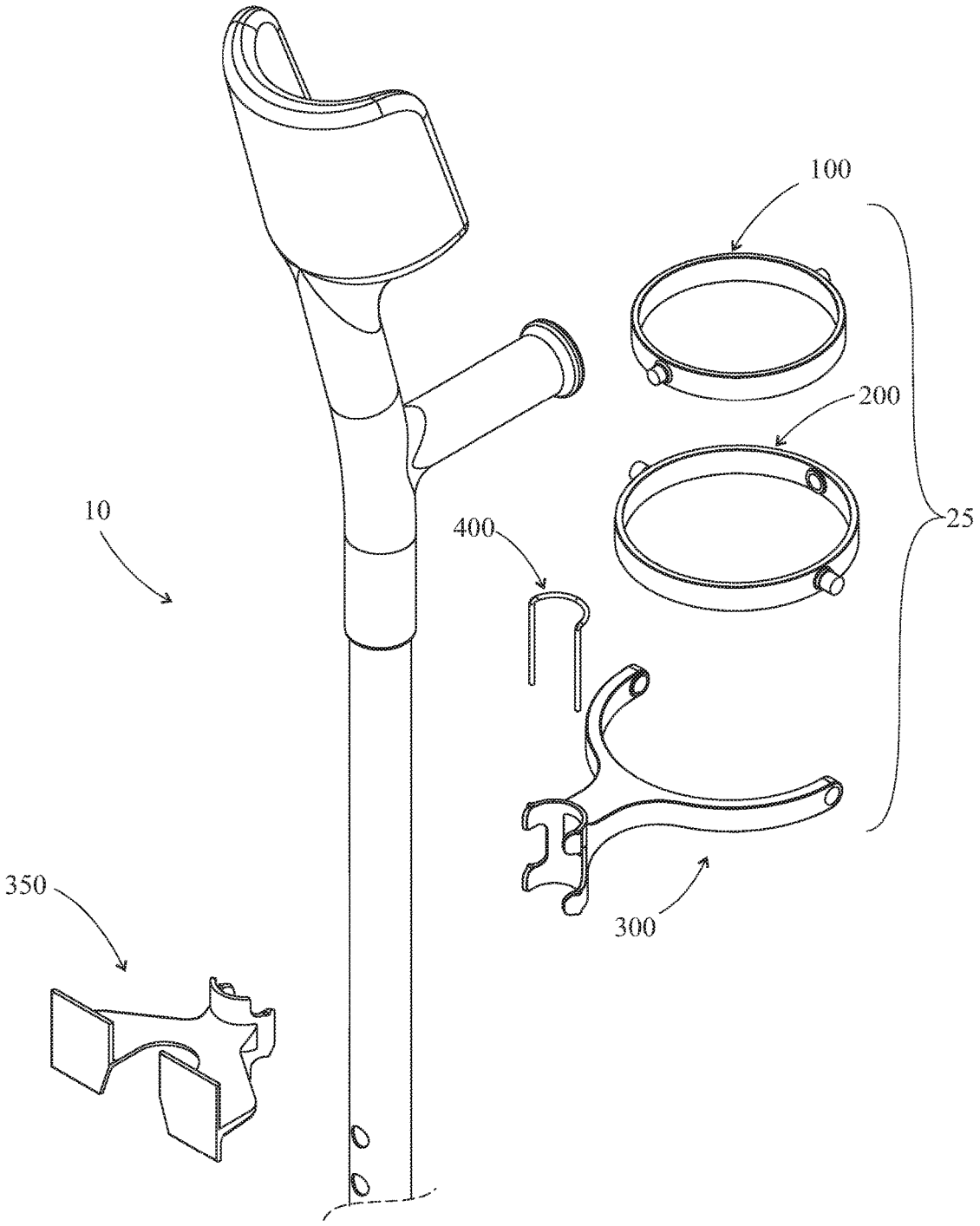
FIG. 2 presents an exploded side elevation isometric view of the cup and bottle holder combination originally introduced in FIG. 1, illustrating the bottle holder component and the individual parts of the cup holder component as separated from the walking aid.

Referring now generally to accompanying FIGS. 1-10, and initially to FIGS. 1-2, the present invention is directed to a combination cup and bottle holder, generally illustrated at 20, that in assembled form is installed on the leg of a walking aid, such as the crutch shaft 12 of an exemplary forearm crutch, generally illustrated at 10. The combination cup and bottle holder includes a bottle holder component 350 and a cup holder component 25.

In general, the combined cup and bottle holder assembly 20 is configured to be releasably coupled to the cylindrical shaft of a walking aid, according to aspects of the present invention. Accordingly, the forearm-type crutch 10 shown in the drawings is merely an illustration of an exemplary walking aid and should not be considered in limitation of the invention. Rather, the invention is available for use with any type of additional walking aid, such as a four-legged walker. Moreover, the combined cup and bottle holder assembly 20 can be integrated with the shaft of any structure, not just walking aids. In the exemplary walking aid, shown in the drawings, the forearm-type crutch 10 includes, in conventional form, a handgrip 16 where the user grips, handles, and otherwise manipulates the crutch 10, and a forearm cuff 18 that serves as a place where the user braces against the crutch shaft 12 for support. The crutch 10 is typically provided with a set of apertures 14 along its shaft 12 to permit length adjustment, in a conventional manner.

Figure 3:
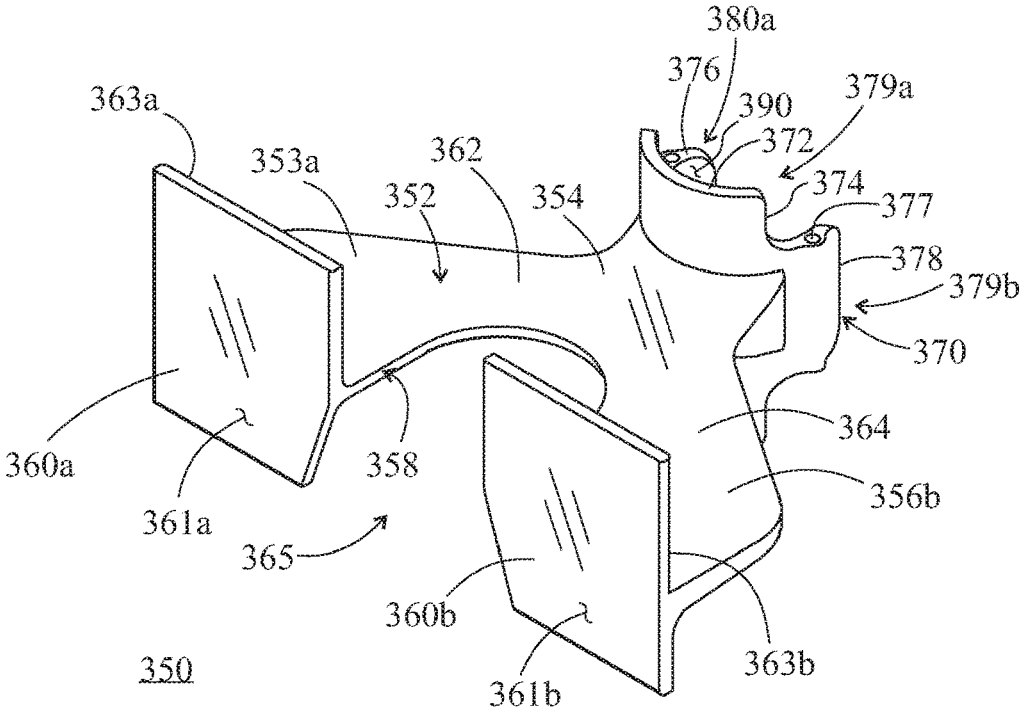
FIG. 3 presents an upper elevation isometric view of the bottle holder component originally introduced in FIG. 1 and further shown in FIG. 2.
Figure 4:
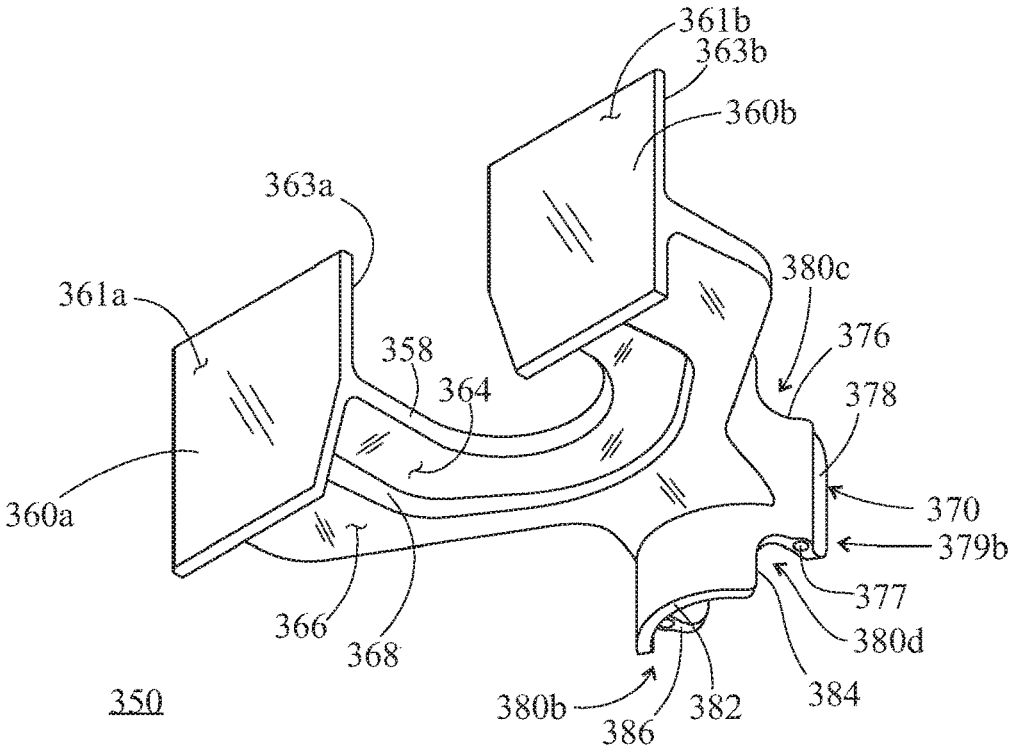
FIG. 4 presents a lower elevation isometric view of the bottle holder component originally introduced in FIG. 1 and further shown in FIG. 2.

Referring still to FIGS. 1 and 2, and in further reference to FIGS. 3 and 4, the illustrated bottle holder component 350 is configured to firmly hold a bottle, such as a beverage container, and to be releasably coupled to the cup holder component 25. In assembled form, the bottle holder component 350 and cup holder component 25 are joined together and arranged in releasable attachment to the crutch shaft 12 of crutch 10.

The bottle holder component 350 includes a main body, generally illustrated at 352, having a flange portion, generally illustrated at 362, and a contiguous neck portion, generally, illustrated at 354. The flange portion 362 includes a pair of spaced-apart wing, prong, or leg sections 353*a* and 356*b* that are arranged in a fork-like fashion. The pair of leg sections 353*a*, 356*b* converges at a common end, where they join in contiguous fashion with neck portion 354, and diverge to terminate at respective ends to form the fork-like arrangement. The body 352 includes an upper surface 364 and a lower surface 366. The pair of leg sections 353*a*, 356*b* forms a generally central space between them, generally illustrated at 365, which is described by an upper inner peripheral edge 358, a lower inner peripheral edge 368, and an inner surface 364 extending between them. This central space 365 defined by the fork-like configuration of flange portion 362 defines a receptacle space for receiving, retaining, and supporting a bottle-type container. In one form, the pair of edges 358, 368 and intervening inner surface 364 define a generally concave feature, although other contours are possible within the scope of the invention that are compatible with the functionality of holding a bottle-type container. The central space 365 formed by the pair of leg sections 353*a*, 356*b* of flange portion 362 is appropriately sized so that a beverage container maneuvered into and located in the space is held there by a press fit engagement with the inner surface 364. In an exemplary form, the combination of flange portion 362 and neck portion 354 provides a wishbone-type formation to body 352. The body 352 can also be considered to have an A-frame or A-arm configuration. Depending on the implementation, the flange portion 362 can be suitably configured to collar the received beverage container at any point along the length of the container. For example, in one form, the flange portion 362 collars a beverage bottle about its neck immediately below the cap, so that the cap engages the upper surface 364 of flange portion 362.

The neck portion 354 of body 352 of bottle holder component 350 defines a region for mounting a first section of a coupling structure, generally illustrated at 370, which mates and interlocks with a second complementary section, generally illustrated at 330 (FIG. 5), belonging to the cup holder component 25. This mating engagement occurs during assembly and installation of the combined cup and bottle holder assembly 20 on shaft 12 of crutch 10. Each of the pair of mating sections 370, 330 incorporates a respective half of a coupling structure that defines a point of releasable attachment between the bottle holder component 350 and the cup holder component 25. Moreover, as discussed further, when the mating sections 370, 330 are coupled together about shaft 12 and releasably secured together, the resultant coupling structure formed by the interconnection of mating sections 370, 330 defines a point at which the combination cup and bottle holder assembly 20 is releasably clamped to crutch 10.

The first coupling section 370 includes an upper edge 372, a lower edge 382, and an inner surface 390 extending between the pair of edges 372, 282. During assembly, the inner surface 390 is disposed in contact, facing opposition to the shaft 12 of crutch 10. For this purpose, the first coupling section 370, and, in particular, the inner surface 390, are configured so that inner surface 390 generally conforms to the shape of the structure to which it is mounted, for example, shaft 12 of crutch 10. In a typical form, when shaft 12 is cylindrical, the inner surface 390 of first coupling section 370 will have a complementary curved or concave shape. In this form, the first coupling section 370 can be considered to feature a cylindrical-type shell or flange formation. The first coupling section 370 includes a pair of symmetrical sides each extending between the upper edge 372 and lower edge 382. Starting at an upper end, each side of first coupling section 370 includes a recessed or upper female portion 380*a* defined by the combination of an axial edge 374 extending axially from upper edge 372, and a circumferential edge 376 contiguous with axial edge 374. Following in sequence around the periphery, the lateral boundary or side of first coupling section 370 continues with a projection or male portion 379*a* defined an axial edge 378 contiguous with circumferential edge 376. Next, the side of first coupling section 370 terminates with another female portion 380*b* defined by the combination of a circumferential edge 386 contiguous with the axial edge 378, and an axial edge 384 contiguous with circumferential edge 386 and extending to the lower edge 382. The other side of first coupling section 370 includes a similar profile having a pair of female portions 380*c*, 380*d* separated by an intermediate male section 379*b*.

The first coupling section 370, then, includes at each side a contour describing a pair of female portions separated by an intermediate male portion. As discussed further, the second coupling section 330 of the cup holder component 25 includes a geometric profile that is complementary to that of first coupling section 370, so that the pair of coupling sections 370, 330 can be interconnected by a mating engagement to form a cylindrical, shell-like clamp about crutch shaft 12 during assembly and installation. The first coupling section 370 further includes a pair of axially-extending channels (not visible) that extend between a pair of apertures 377 formed in the circumferential edges 376, 386 at both sides of first coupling section 370. Each one of the channels passes axially through the interior of a respective one of the male portions of first coupling section 370. As discussed further in connection with 5, the purpose of these channels is provide a receptacle space for receiving an attachment pin 400 (FIG. 5), which serves to releasably attach the coupling sections 370, 330 together, and, thus, to releasably attach the bottle holder component 350 and cup holder component 25. In turn, this assembled combination 20 is thereby releasably clamped to crutch shaft 12.

The particular geometries of mating flange section 370 (of bottle holder component 350) and flange section 330 (of cup holder component 25) should not be considered in limitation of the present invention. Rather, the coupling structure produced by the pair of mating flange sections 370, 330 can be provided in any form capable of releasably joining bottle holder component 350 and cup holder component 25 in an assembled form that simultaneously releasably clamps the combination cup and bottle holder assembly 20 to shaft 12 of crutch 10. Such a coupling structure can have any design suitable to accomplish this assembled joining and clamping functionality.

The illustrated bottle holder component 350 further includes a pair of spaced-apart bumper-style elements or bump stops 360*a*, 360*b* each disposed at a respective terminal end of a corresponding one of the leg sections 353*a*, 356*b* of flange portion 362 of body 352. The bump stops

360*a*, 360*b* each have a respective pair of corresponding front surfaces 361*a*, 361*b* and a respective pair of corresponding back surfaces 363*a*, 363*b*. The bump stops 360*a*, 360*b* have a generally planar arrangement and can take a variety of shapes. In one arrangement of the combined cup and bottle holder assembly 20, the bottle holder component 350 projects outwardly from crutch shaft 12 in a direction towards the crutch operator, who is stationed in an operating position relative to crutch 10, i.e., the user is grasping handgrip 16 and bracing against forearm cuff 18. In such an orientation, the purpose of the pair of bump stops 360*a*, 360*b* is to provide a point of contact between the user and the bottle holder component 350 in case the user happens to bump up against component 350, for example, the user's lower leg swings against and strikes component 350. If this occurs, the pair of bump stops 360*a*, 360*b* protects the user from directly striking or disturbing the placement of the beverage container in bottle holder component 350. In alternative orientations, when bottle holder component 350 projects in a direction oblique from the crutch operator, the pair of bump stops 360*a*, 360*b* serve a similar function to protect the integrity of component 350 from inadvertent contact with surrounding objects as the crutch 10 is maneuvered about. In one form, the pair of bump stops 360*a*, 360*b* can be made of a resilient, cushion-type material.

Figure 5:
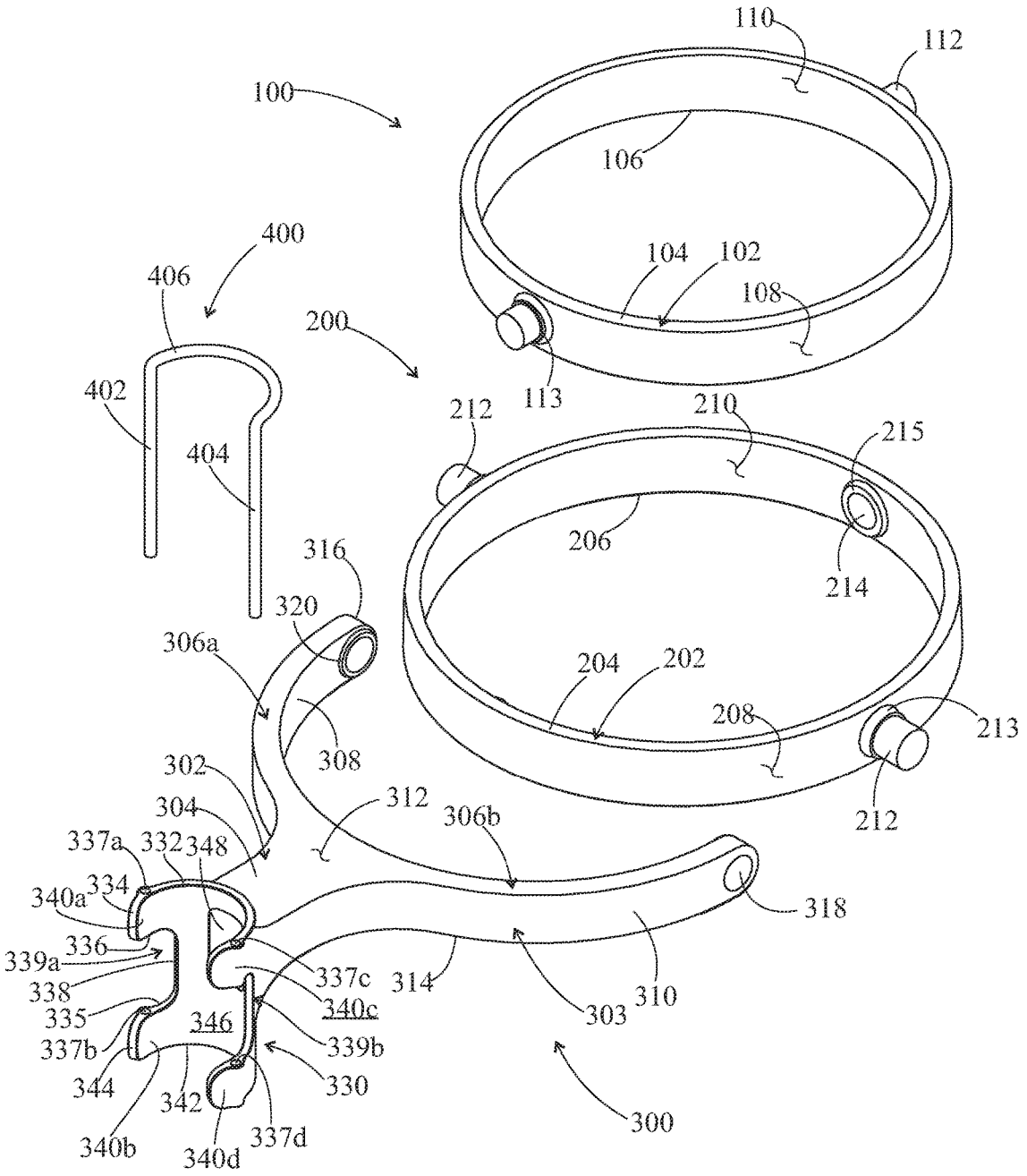
FIG. 5 presents an exploded upper elevation isometric view of the cup holder component original introduced in FIGS. 1 and 2, illustrating the individual parts of the cup holder component in enlarged form.

Referring again to FIGS. 1 and 2, and in further reference to FIG. 5, the illustrated cup holder component 25 includes, in combination, an outer ring support component 300, an outer ring 200 pivotably supported by outer ring support component 300, and an inner ring 100 concentric with outer ring 200 and pivotably supported by outer ring 200. The inner ring 100 and outer ring 200 each has a pivoting axis different from one another. The illustrated outer ring support component 300 includes a body 302 having a semi-circular flange portion, generally illustrated at 303, and a neck portion 304 contiguous with semi-circular flange portion 303. The flange portion 303 includes a pair of leg sections 306*a*, 306*b* that together define the semi-circular configuration of flange portion 303. The body 302 includes an upper surface 312, a lower surface 314, an inner surface 308, and an outer surface 310. The flange portion 303 includes a pair of pivot nub-receiving apertures 316, 318 each located at a terminal end of a respective one of the pair of leg sections 306*a*, 306*b*. Each of the apertures 316, 318 extends fully between the inner surface 308 and outer surface 310 of body 302. Each aperture 316, 318 is accompanied by a boss 320 located at the inner surface 308 of body 302.

The neck portion 304 of outer ring support component 300 includes a second coupling flange section, generally illustrated at 330, that is complementary to, and mates with, the first coupling flange section 370 (FIGS. 3 and 4) of bottle holder component 350. This second coupling flange section 370 is located at a terminal end 348 of neck portion 304. The second coupling section 330 includes an upper edge 332, a lower edge 342, and an inner surface 346 extending between the pair of edges 332, 342. During assembly, the inner surface 346 is disposed in contact, facing opposition to the shaft 12 of crutch 10. For this purpose, the second coupling section 330, and, in particular, the inner surface 346, are configured so that inner surface 346 generally conforms to the shape of the structure to which it is mounted, for example, shaft 12 of crutch 10. In a typical form, when shaft 12 is cylindrical, the inner surface 346 of second coupling section 330 will have a complementary curved or concave shape. In this form, the second coupling section 330 can be considered to feature a cylindrical-type shell or flange formation. The second coupling section 330 includes a pair of symmetrical sides each extending between the upper edge 332 and lower edge 342. Starting at an upper end, each side of second coupling section 330 includes an ear or male portion 340*a* defined by the combination of an axial edge 334 extending axially from upper edge 332, and a circumferential edge 336 contiguous with axial edge 334. Following in sequence around the periphery, the side of second coupling section 330 continues with a recessed or female portion 339*a* defined an axial edge 338 contiguous with a pair of circumferential edges 336, 335. Next, the side of second coupling section 330 terminates with another ear or male portion 340*b* defined by the combination of a circumferential edge 335, and an axial edge 344 contiguous with circumferential edge 335 and extending to the lower edge 342. The other side of second flange section 330 is similarly configured and includes a pair of ears or male portions 340*c*, 340*d* separated by an intermediate female section 339*b*.

The second coupling section 330, then, includes at each side a contour describing a pair of male portions separated by an intermediate female portion. This profile is complementary to that of the first coupling section 370, which includes at each side a profile describing a pair of female portions separated by an intermediate male portion. During assembly, the first coupling section 370 (bottle holder component 350) and second coupling section 330 (cup holder component 25) are joined together in mating engagement, matching the male sections to counterpart female sections. In particular, with reference to FIGS. 3-5, the upper male portion 340*a*, female section 339*a*, and lower male portion 340*b* of second coupling section 330 are mated respectively with counterparts consisting of upper female portion 380*a*, male section 379*a*, and lower female portion 380*b* of first coupling section 370. Similarly, at the other side of the coupling structure, the upper male portion 340*c*, female section 339*b*, and lower male portion 340*d* of second coupling section 330 are mated respectively with counterparts consisting of upper female portion 380*c*, male section 379*b*, and lower female portion 380*d* of first coupling section 370.

The second coupling section 330 further includes a pair of apertures 337*a*, 337*b* formed respectively at edges of the pair of male portions, 340*a* and 340*b*. These apertures 337*a*, 337*b* define channels (not visible) that extend axially through the pair of male portions 340*a*, 340*b*. In similar fashion, at the other side of second coupling section 330, a pair of apertures 337*c*, 337*d* are formed respectively at edges of the pair of male portions 340*c*, 340*d*. When the first coupling section 370 (bottle holder component 350) and second coupling section 330 (cup holder component 25) are assembled, the pair of apertures 337*a*, 337*b* of second coupling section 330 align with aperture 377 of first coupling section 370 at one side of the assembly, while the pair of apertures 337*c*, 337*d* align with aperture 377 at another side of the assembly. In this manner, via alignment of the apertures, a pair of pin-receiving, axially-extending channels are formed at respective sides of the assembled coupling structure (second coupling section 330 and first coupling section 370), which extend fully from the upper end to the lower end of the assembled coupling structure. This pair of pin-receiving channels accommodates reception of attachment pin 400 (FIG. 5), which holds the assembled coupling sections 330, 370 together in mating engagement, as discussed further.

Figure 10:
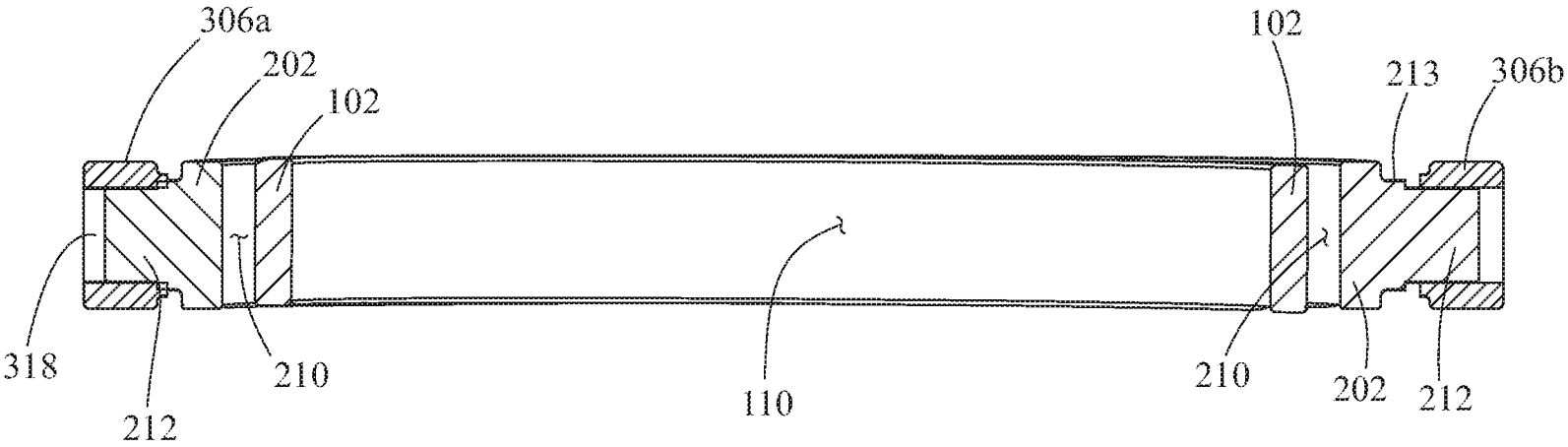
FIG. 10 presents a cross-sectional view of the cup holder component originally introduced in FIG. 1, as taken along section line 10-10, illustrating how the outer ring is pivotably supported by the outer ring support component in the cup holder subassembly.

Referring still to FIG. 5, the illustrated outer ring 200 includes a main body 202 having an upper edge 204, lower edge 206, an interior surface 210 extending between the edges 204, 206, and an exterior surface 208 extending between the edges 204, 206. The outer ring 200 includes a pair of pivot pins, nubs, or studs 212 that are disposed diametrically opposite one another and project radially outward from exterior surface 208. Each pivot nub 212 is fitted with an accompanying boss 213 at exterior surface 208. During assembly, the outer ring 200 is pivotably mounted to outer ring support component 300 by locating and registering the pair of pivot nubs 212 of outer ring 200 in the pair of apertures 316, 318 formed at the terminal ends of the semi-circular flange portion 303 of outer ring support component 300, as best seen in FIG. 10. The pair of boss 213 of outer ring 200 function as spacer elements that establish an adequate clearance between the exterior surface 208 of outer ring 200 and the interior surface 308 of outer ring support component 300 in the assembled arrangement, allowing free and contact-less relative rotation between outer ring 200 and outer ring support component 300. The pair of nubs 212 of outer ring 200 define a first axis of pivoting rotation describing the possible relative rotation between outer ring 200 and outer ring support component 300. The outer ring 200 further includes a pair of nub-receiving cavity 214 that are disposed diametrically opposite one another and extend fully between the interior surface 210 and exterior surface 208. Each nub-receiving cavity 214 is fitted with an accompanying boss 215 at interior surface 210. The nub-receiving cavities 214 are concentric about, and thereby define, a common second axis of pivoting rotation describing the possible relative rotation between inner ring 100 and both outer ring support component 300 and outer ring 200, as discussed further.

Figure 9:
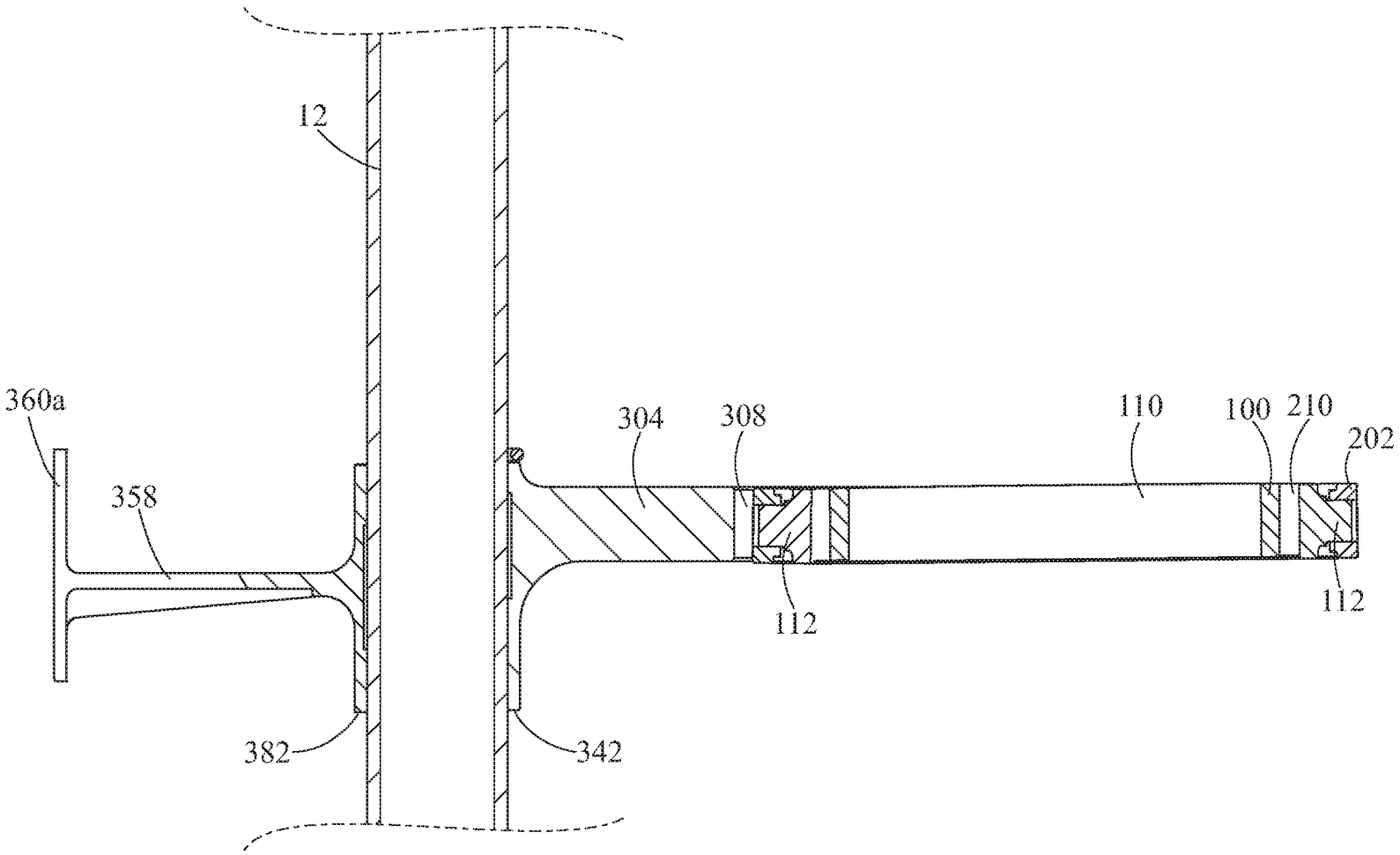
FIG. 9 presents a cross-sectional view of the combined cup and beverage holder assembly originally introduced in FIG. 1, as taken along section line 9-9, illustrating how the inner ring is pivotably supported by the outer ring in the cup holder subassembly.

The inner ring 100 of cup holder component 25 includes a main body 102 having an upper edge 104, lower edge 106, an interior surface 110 extending between the edges 104, 106, and an exterior surface 108 extending between the edges 104, 106. The inner ring 100 includes a pair of pivot pins, nubs, or studs 112 that are disposed diametrically opposite one another and project radially outward from exterior surface 108. Each pivot nub 112 is fitted with an accompanying boss 113 at exterior surface 108. During assembly, the inner ring 100 is pivotably mounted in concentric fashion to outer ring 200 by locating and registering the pair of pivot nubs 112 of inner ring 100 in the pair of nub-receiving cavity 214 formed in outer ring 200, as best seen in FIG. 9. The pair of boss 113 of inner ring 100 function as spacer elements that establish an adequate clearance between the exterior surface 108 of inner ring 100 and the interior surface 210 of outer ring 200 in the assembled arrangement, allowing free and contact-less relative rotation between inner ring 100 and outer ring 200. The nubs 112 of inner ring 100 define a second axis of pivoting rotation describing the possible relative rotation between inner ring 100 and outer ring 200.

Referring to the subassembly of cup holder component 25, the combination of inner ring 100 and outer ring 200 forms a gimbal arrangement having a gyroscopic relationship to outer ring support component 300. In particular, as discussed further in relation to FIGS. 6-8, the cup holder component 25 is able to incline freely in at least two tilt planes, while enabling the cup 40 suspended and supported within the gimbal ring structure to remain level or horizontal even though its support (outer ring support component 300) is inclined or tipped. The ability to stabilize the orientation of cup 40 and keep it level is beneficial since cup 40, unlike bottle 30, is typically not capped or fully sealed, so that liquid can spill if cup 40 is sufficiently tilted, especially when it is full or nearly full of liquid. The cup 40, then, remains properly oriented in facing towards the horizon, despite tilting of the walking aid 10. The combination of inner ring 100 and outer ring 200 is suspended in a pivotal mounting relationship to outer ring support component 300. The outer ring 200 is pivotably mounted to support component 300 to define a pivoting axis that represents a freedom of movement for support component 300 relative to outer ring 200 that is analogous to a pitching displacement. In such a pitching motion, the pivoting axis may be considered a lateral axis (i.e., perpendicular to the direction of travel), with the tilt plane analogous to the sagittal plane from the user's perspective (i.e., forward-backward movements of crutch shaft 12). The inner ring 100 is pivotably mounted to outer ring 200 to define a pivoting axis that represents a freedom of movement for support component 300 relative to inner ring 100 that is analogous to a rolling displacement. In such a rolling motion, the pivoting axis may be considered a longitudinal axis (i.e., parallel to the direction of travel), with the tilt plane analogous to the coronal plane from the user's perspective (i.e., side-to-side movements of crutch shaft 12). These pivoting axes are orthogonal to one another. Due to this gimbal-based, gyroscopic functionality of cup holder component 25, the assembly 20 is able to self-adjust as crutch shaft 12 tilts or inclines from the vertical, exhibiting a gyroscopic action as the relevant gimbal ring remains level and horizontal during the tilting of the gimbal support (outer ring support component 300).

In one exemplary implementation, the bottle holder component 350 includes a bottle-engaging structure (main body 352) that projects outwardly in a first direction, and includes the first half of a coupling structure (first coupling section 370) that projects outwardly in an opposite second direction. Additionally, the cup holder component 25 includes a cup retention subassembly having a gimbal-based, gyroscopic type cup-holding portion (support component 300, outer ring 200, inner ring 100) that projects outwardly in a third direction, and includes the second half of the coupling structure (second coupling section 330) that projects outwardly in a fourth direction opposite the third direction. In a preferred form, the first direction and the fourth direction are coincident, while the second direction and the third direction are coincident. As a result, when assembled, the bottle holder component 350 and cup holder component 25 are diametrically opposite one another about crutch shaft 12. Moreover, in a preferred installation and deployment of assembly 20 on crutch 10, the bottle holder component 350 projects towards the user, while the cup holder component 25 projects away from the user, although other orientations are possible about crutch shaft 12.

Regarding now the means for fastening together the first coupling section 370 and second coupling section 330, once assembled, the illustrated attachment pin 400 (FIG. 5) includes a pair of spaced-apart vertical length sections 402, 404 connected at upper ends to a semi-circular length section 406. During assembly, the first coupling section 370 of bottle holder component 350 and the second coupling section 330 of cup holder component 25 are mated together about shaft 12 of crutch 10, interlocking to form a cylindrical, shell-like coupling structure that fully surrounds shaft 12. In this assembled arrangement, as discussed previously, the apertures of first coupling section 370 and second coupling section 330 align with one another to form a pair of axial pin-receiving channels that extend fully along the length of the assembled coupling structure through the set of male portions. In particular, one pin-receiving channel extends, in the assembled configuration, through the pair of male portions 340*a*, 340*b* (second coupling section 330) and intermediate male portion 379*a* (first coupling section 370), while the other pin-receiving channel extends through the pair of male portions 340*c*, 340*d* (second coupling section 330) and intermediate male portion 379*b* (first coupling section 370). The pair of vertical length sections 402, 404 of attachment pin 400 is inserted into the pair of pin-receiving channels to releasably lock together the first coupling section 370 and second coupling section 330. In so doing, the bottle holder component 350 and cup holder component 25 are likewise releasably connected. This form of releasable attachment allows the components to be disconnected by simply removing the attachment pin 400, i.e., withdrawing the pin 400 from the pin-receiving channels formed in the coupling sections 330, 370. The functionality of first coupling section 370 and second coupling section 330 enables the combination of bottle holder component 350 and cup holder component 25 to be located anywhere vertically along crutch shaft 12 and at any diametric location about crutch shaft 12. The curvature of semi-circular length 406 of attachment pin 400 conforms to the cylindrical shape of the crutch shaft 12 to facilitate proper seating of pin 400 when it is inserted into the pin-receiving channels of the assembled coupling sections 330, 370.

Although the coupling sections 330, 370 are fastened together, and thereby releasably locked, using an external mechanism (attachment pin 400), it is also possible that coupling sections 330, 370 can be configured to permit a self-locking or automatic interconnect feature once they are assembled.

Figure 6:
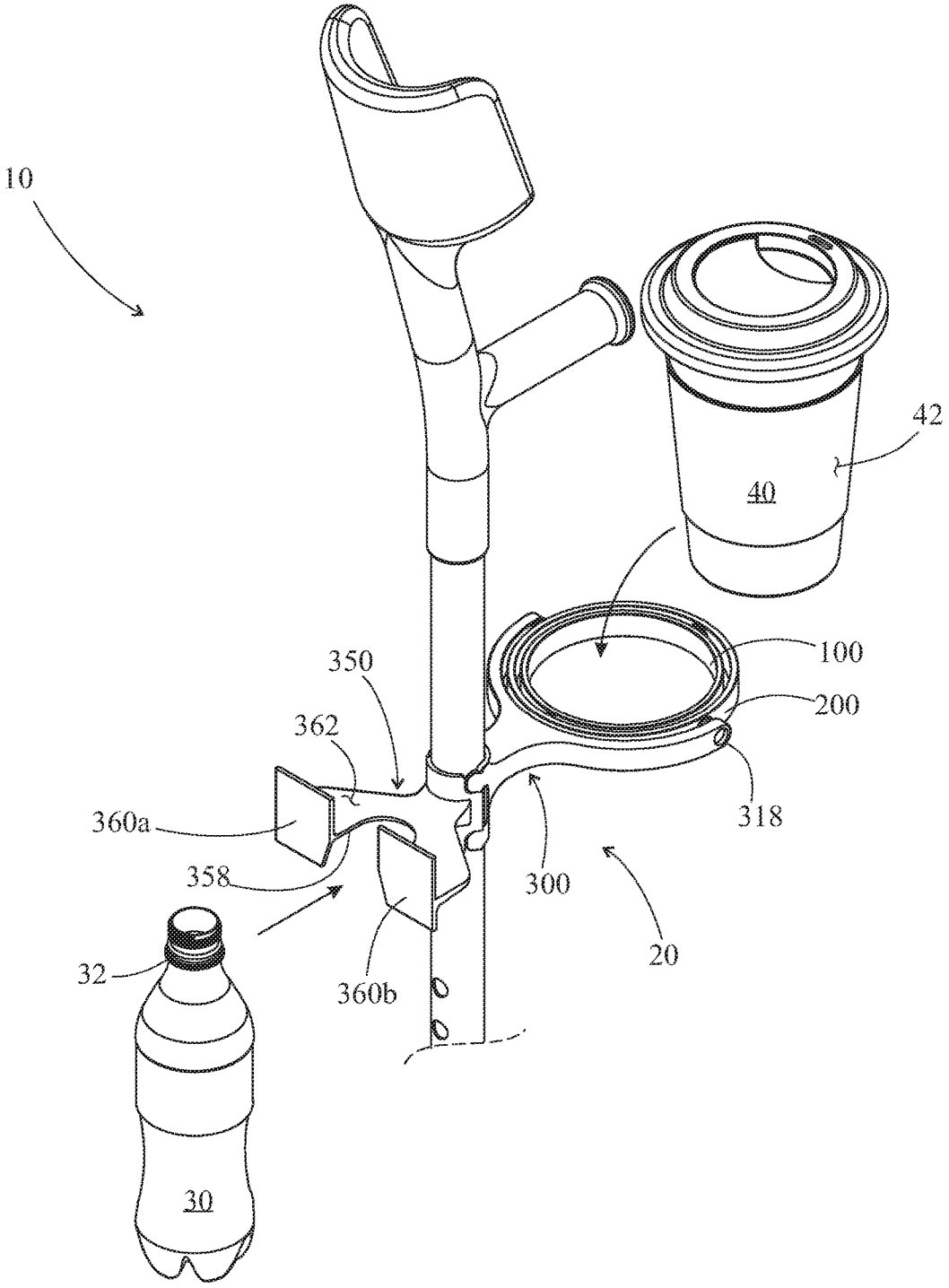
FIG. 6 presents a side elevation isometric view of the combined cup and bottle holder assembly originally introduced in FIG. 1 in its installed condition, illustrating an exemplary form of use depicting how to place a beverage bottle in the bottle holder component and how to place a beverage cup in the cup holder component.
Figure 7:
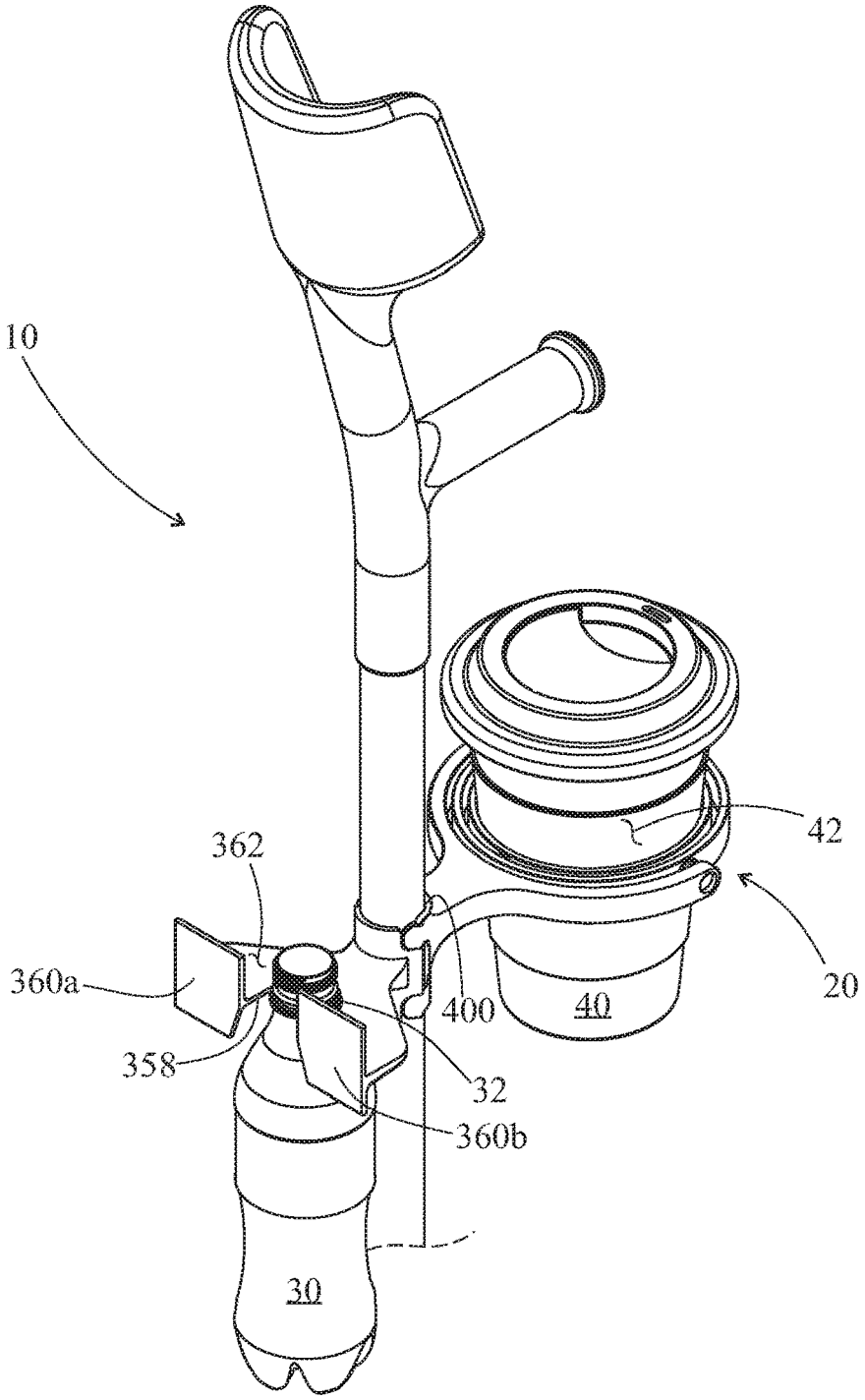
FIG. 7 presents a side elevation isometric view of the cup and bottle holder combination originally introduced in FIG. 1 in its assembled and installed condition and further shown in FIG. 8, illustrating how the bottle holder component retains and carries the beverage bottle and how the cup holder component retains and carries the beverage cup.
Figure 8:
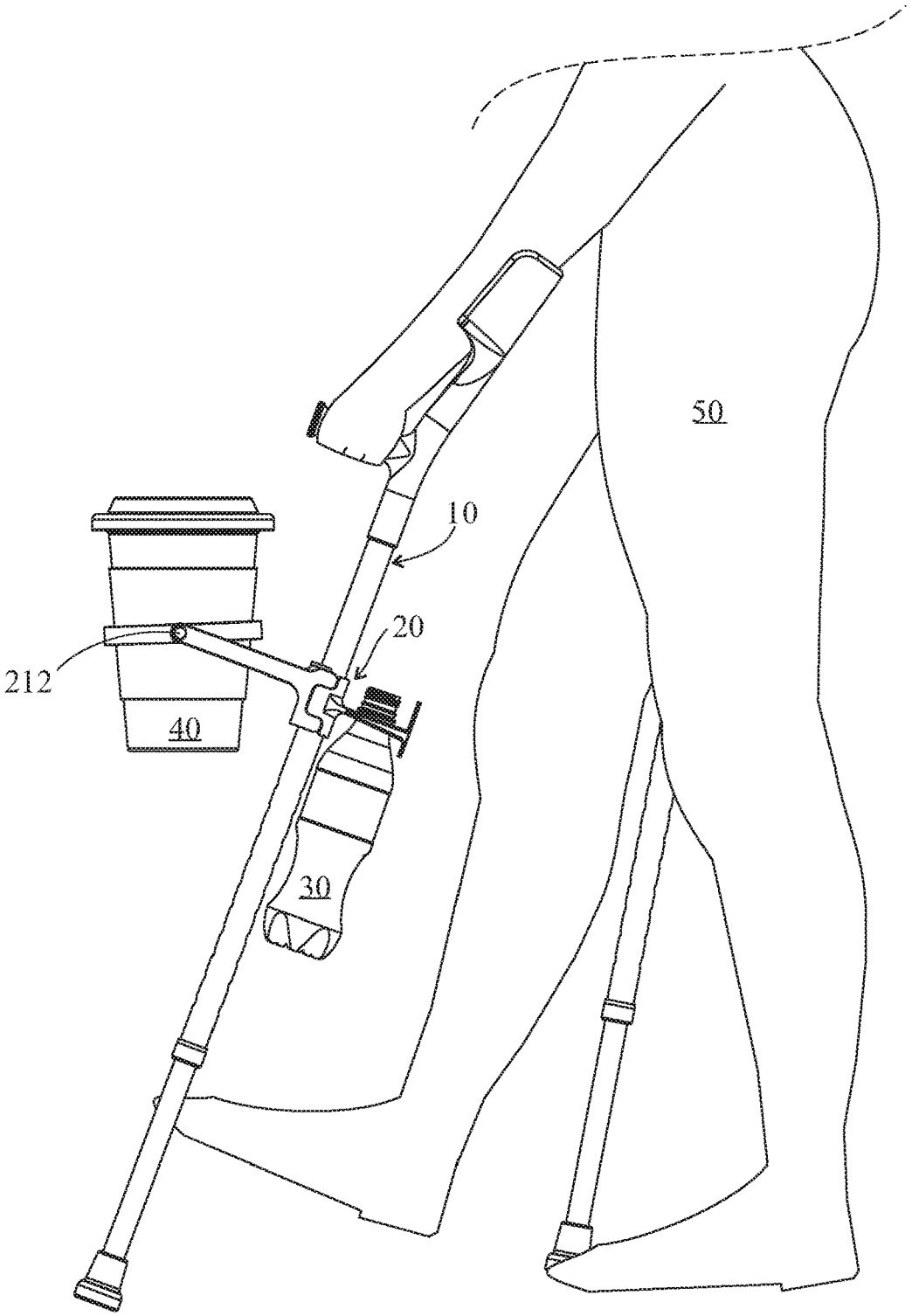
FIG. 8 is a side elevation isometric view of the cup and bottle holder combination originally introduced in FIG. 1 and further depicted in FIG. 7, illustrating the use and operation of the cup and holder combination as an individual maneuvers the walking aid; and specifically illustrating how the cup holder component maintains the level orientation of the carried beverage cup during the typical swinging movement of the walking aid.

Reference is now made to FIGS. 6-8 to describe the operation of the combined cup and bottle holder assembly 20. In operation, the cup holder component 25 has a gimbal-based, gyroscopic-type functionality based on the configuration of the subassembly that constitutes cup holder component 25, namely, the combination of outer ring support component 300, outer ring 200 pivotably supported by component 300, and inner ring 100 concentric with and pivotably supported by outer ring 200. During use, after the combined cup and bottle holder assembly 20 has been installed on crutch 10, a user places cup 40 through the interior space of inner ring 100 of cup holder component 25. The cup 40 comes to rest within inner ring 100 when the outer surface 42 of cup 40 acquires a sufficient diameter to create a press-fit contact with the inner surface 110 of inner ring 100. The dual ring gimbal structure (inner ring 100 and outer ring 200) provides cup holder component 25 with two degrees of rotational freedom in terms of permitting independent relative rotation (pivoting) between the outer ring support component 300 and each one of the rings 100, 200.

Referring to FIG. 8, in one exemplary implementation, the combined cup and bottle holder assembly 20 is oriented so that the cup holder component 25 is on the same side of crutch shaft 12 as handgrip 16, placing the cup holder component 25 in the most forward position possible, which in turn places the bottle holder component 350 in the most rearward position possible. In a typical gait aided by a walker, the crutch 10 does not normally remain in a vertical position, but is angled relative to the ground as the user attempts to travel forward by first placing the crutch 10 in a forward location at a new stable position and then bringing the body forward to meet the crutch 10. The rigid main bodies of both cup holder component 25 and bottle holder component 350 project, generally, in an orthogonal direction to the crutch shaft 12. Throughout the user's travel, the crutch 10 may at times be oriented near vertically, but a significant amount of time may be spent with the crutch 10 in the angled position illustratively shown in FIG. 8.

The cup holder component 25 can accommodate both a forward-leaning pitch and a rearward-leaning pitch of crutch 10 (such as FIG. 8) relative to an upright vertical dimension, in a manner that maintains the level orientation of the seated cup 40. For example, these displacements may be considered to occur in a front-to-back (forward-backward) dimension from the user's perspective, namely, along a line parallel to the user's direction of travel. These forward-backward displacements specify a vertical tilt plane parallel to the user's direction of travel. When the crutch shaft 12 is in the upright, vertical position, the rigid outer ring support component 300 of cup holder component 25 is oriented generally horizontally or parallel to the ground. In the event of such forward-backward tilting of crutch 10 from the vertical direction, such as shown in FIG. 8, the outer ring support component 300 experiences a corresponding shift from the horizontal orientation, i.e., it can tilt up (FIG. 8) or tilt down, depending on the position of the crutch shaft 12. This shift is equivalent to a rotational displacement of outer ring support component 300 about an axis perpendicular to the tilt plane (i.e., perpendicular to the crutch shaft 12 and perpendicular to the line of travel). Such a rotational axis (i.e., pertaining to the forward-backward tilt of crutch 10) is parallel to the pivot axis established between outer ring 200 and outer ring support component 300, causing relative rotation between outer ring 200 and outer ring support component 300. In the illustrated assembly, the outer ring 200 is pivotably supported by outer ring support component 300 about a pivoting axis that is generally perpendicular to the line of travel. Accordingly, in response to the up-down tilting activity of outer ring support component 300 (as crutch shaft 12 is angled), the outer ring support component 300 correspondingly pivots relative to outer ring 200, while outer ring 200 (and concentric ring 100) remain steady at a generally level orientation parallel to the ground.

The pivot axes of outer ring 200 and inner ring 100 are preferably oriented orthogonally to one another. This has the effect of ensuring that when outer ring support component 300 is displaced in a rotational direction strictly about the pivot axis of outer ring 200 accompanying a forward-backward tilt), the inner ring 100 remains stationary in its concentric relationship with outer ring 200. Furthermore, the orthogonal orientation of the pivot axes has the effect of ensuring that when outer ring support component 300 is displaced in a rotational direction strictly about the pivot axis of inner ring 100 (i.e., a lateral tilt), the outer ring 200 travels in tandem with the as-displaced outer ring support component 300, so that such lateral tilting is marked by a rotation of the combination of outer ring 200 and outer ring support component 300 relative to the generally stationary inner ring 100.

As noted, in addition to a forward-backward tilting of crutch 10, another range of movement for crutch 10 can occur in the side-to-side direction, namely, along a line generally perpendicular to the user's direction of travel. These side-to-side (lateral) displacements specify a vertical tilt plane perpendicular to the user's direction of travel. In the event of such lateral tilting of crutch 10 from the vertical direction, the outer ring support component 300 will correspondingly tilt in a manner that is equivalent to a rotational displacement about an axis perpendicular to the tilt plane (i.e., perpendicular to the crutch shaft 12 and parallel to the line of travel). Such a rotational axis (i.e., pertaining to the lateral tilt of crutch 10) is parallel to the pivot axis established between inner ring 100 and outer ring 200, causing relative rotation between inner ring 100 and outer ring support component 300. The lateral tilt plane is parallel to the pivot axis between outer ring support component 300 and outer ring 200, meaning that outer ring 200 will not pivot but will instead accompany the tilt of outer ring support component 300. Accordingly, in a lateral tilting of crutch 10, the combined outer ring support component 300 and outer ring 200 will pivot in tandem relative to inner ring 100, which will remain steady at a general level orientation parallel to the ground.

As shown in FIG. 8, the bottle 30 is retained in bottle holder component 350 by securing bottle 30 proximally in the area of the top or cap portion 32. However, it is possible to secure bottle 30 at other locations along its length by appropriately shaping and configuring the flange-type engagement offered by main body 352 of bottle holder component 350.

Since many modifications, variations, and changes in detail can be made to describe preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A combined cup and bottle holder assembly coupleable to a shaft length of a walking aid, the assembly comprising:

a bottle support component having a bottle receiving and holding portion;

a cup support subassembly having a gimbal cup receiving and holding portion; and a coupling device including a first portion and a second portion selectively releasably coupleable together about the shaft length of the walking aid, the first portion disposed at a mounting end of the bottle support component and the second portion disposed at a mounting end of the cup support subassembly, the first portion of the coupling device including an upper edge, a lower edge, and a pair of symmetrical sides extending between therebetween, each respective one of the pair of symmetrical sides having a male section interposed by a corresponding pair of female sections, the second portion of the coupling device including an upper edge, a lower edge, and a pair of symmetrical sides extending therebetween, each respective one of the pair of symmetrical sides of the second portion having a female section interposed by a corresponding pair of male sections, wherein the first portion and the second portion of the coupling device are mateable via engagement of counterpart male sections and female sections thereof.

2. An assembly as recited in claim 1, further comprising:

an attachment pin configured to selectively fasten the first portion and the second portion of the coupling device to one another and to the shaft length.

3. An assembly as recited in claim 1, the bottle receiving and holding portion of the bottle support component further comprising:

a body including a pair of spaced-apart leg sections defining a bottle-receiving space therebetween.

4. An assembly as recited in claim 1, the cup support subassembly further comprising a support component; and the gimbal cup receiving and holding portion further comprising an outer ring pivotably supported by the support component to define a first pivot axis, and having an inner ring concentric with, and pivotably supported by, the outer ring to define a second pivot axis.

5. An assembly as recited in claim 4, the support component of the cup support subassembly further comprising a semi-circular portion having a pair of distal ends pivotably-supporting the outer ring.

6. An assembly as recited in claim 4, the first pivot axis further comprising a first pivot axis associated with a pitching-type displacement of the walking aid; and the second pivot axis further comprising a second pivot axis associated with a rolling-type displacement of the walking aid.

7. An assembly as recited in claim 1, further comprising:

a set of channels each formed through a respective one of the male sections of the first portion and the second portion of the coupling device to define a pair of pin-receiving passageways each formed through a respective sequence of male sections in a coupled assembly of the first portion and the second portion of the coupling device; and an attachment pin having an upper section and a pair of spaced-apart vertical sections extending from the upper section, each one of the attachment pin vertical sections selectively receivable within a respective one of the pair of pin-receiving passageways.

8. An assembly as recited in claim 1, further comprising:

a first cylindrical fragment defined by the first portion of the coupling device; and a second cylindrical fragment defined by the second portion of the coupling device, the second cylindrical fragment complementary to, and mateable with, the first cylindrical fragment.

9. An assembly as recited in claim 1, further comprising:

said bottle receiving and holding portion of the bottle support component projecting outwardly in a first direction, and the first portion of the coupling device disposed at the mounting end of the bottle support component projecting outwardly in an opposite second direction; and said gimbal cup receiving and holding portion of the cup support subassembly projecting outwardly in the second direction, and the second portion of the coupling device disposed at the mounting end of the cup support assembly projecting outwardly in the first direction.

10. A combined cup and necked bottle holder assembly coupleable to a cylindrical shaft length of a walking aid, the assembly comprising:

a unitary necked bottle support component having a bottleneck-retaining portion projecting outwardly in a first direction, and having a first half of a coupling structure projecting outwardly in an opposite second direction, the first half of said coupling structure having a concave shape conforming to a convex exterior surface of said cylindrical shaft length;

a one-piece Y-shaped cup retention component having a U-shaped mounting support for a cup-retention subassembly projecting outwardly in a third direction, and having a second half of the coupling structure projecting outwardly in an opposite fourth direction, the second half of the coupling structure having a concave shape conforming to the convex exterior surface of the cylindrical shaft length, the first and second halves of the coupling structure having perimeter edge profiles that mate with one another during assembly of the coupling structure to the cylindrical shaft length; and an attachment element configured to selectively releasably fasten the first and second coupling structure halves to one another in a coupling relationship about the shaft length of the walking aid.

11. An assembly as recited in claim 10, the cup retention subassembly further comprising:

a two-axis gimbal arrangement rotatably coupled to terminal ends of a pair of leg portions of said one-piece Y-shaped cup retention component.

12. An assembly as recited in claim 11, the cup retention subassembly further comprising:

an outer ring pivotably supported by the terminal ends of the pair of leg portions of the one-piece Y-shaped cup retention component; and an inner ring concentric with, and pivotably supported by, the outer ring.

13. An assembly as recited in claim 10, wherein the first direction of the outwardly-projecting bottleneck-retaining portion of the bottle support component and the fourth direction of the second half of the coupling structure are coincident, and the second direction of the first half of the coupling structure and the third direction of the U-shaped mounting support of the Y-shaped cup retention component are coincident.

14. A combined cup and bottle holder assembly coupleable to a shaft length of a walking aid, the assembly comprising:

a bottle support component having bottle-engaging structure projecting outwardly in a first direction and having a first half of a coupling structure projecting outwardly in an opposite second direction, the first half of the coupling device including a first arrangement of male and female sections;

a cup retention subassembly having a gyroscopic cup-holding portion projecting outwardly in the second direction and having a second half of said coupling structure projecting outwardly in the first direction, the second half of the coupling device including a second arrangement of male and female sections, the first arrangement and the second arrangement being complementary to, and mateable with, one another; and an attachment pin for selective coupling of said first and second coupling structure halves to one another about said shaft length.

15. An assembly as recited in claim 14, the cup retention subassembly further comprising an outer ring support component; and the gyroscopic cup-holding portion of the cup retention subassembly further comprising an outer ring pivotably supported by the outer ring support component and having an inner ring pivotably supported by the outer ring.

16. An assembly as recited in claim 14, the gyroscopic cup-holding portion of the cup retention subassembly further comprising:

a gimbal device.

* * * * *